US006230902B1

(12) United States Patent
Bird et al.

(10) Patent No.: US 6,230,902 B1
(45) Date of Patent: May 15, 2001

(54) CONFECTIONER'S WORKSTATION

(76) Inventors: Sheala J. Bird, 113 E. First, Sulpher, OK (US) 73086; Kimberly N. Buland, 999-9 Evelyn Ter. West, Sunnyvale, CA (US) 94086

( * ) Notice: Subject to any disclaimer, the term of this patent is extended or adjusted under 35 U.S.C. 154(b) by 0 days.

(21) Appl. No.: 09/467,899

(22) Filed: Dec. 21, 1999

Related U.S. Application Data

(60) Provisional application No. 60/113,533, filed on Dec. 22, 1998.

(51) Int. Cl.[7] ..... A47F 7/00

(52) U.S. Cl. ..... 211/13.1; 211/10; 211/27; 211/85.4; 99/484; 99/646 R

(58) Field of Search ..... 211/10, 71.01, 211/88.01, 90.04, 60.1, 13.1, 85.4, 27; 99/352, 484–485, 646 R; D7/323, 327, 339, 368, 412, 213; 312/107, 126, 128, 237

(56) References Cited

U.S. PATENT DOCUMENTS

| | | | | |
|---|---|---|---|---|
| Re. 36,134 | * | 3/1999 | Stein | 211/133.6 |
| D. 176,117 | * | 11/1955 | Hanson | D7/339 |
| D. 222,515 | * | 10/1971 | Goetz | D7/339 |
| D. 287,795 | * | 1/1987 | Streepy | D7/339 |
| D. 291,047 | * | 7/1987 | Pappas | D7/339 |
| 905,578 | * | 12/1908 | Read | 211/10 |
| 1,593,326 | * | 7/1926 | Bourn | 211/10 |
| 2,187,596 | * | 1/1940 | Zaninovich | 211/85.4 |
| 2,409,117 | * | 10/1946 | Fero | 312/107 |
| 2,525,208 | * | 10/1950 | Clink | 211/70.6 |
| 3,759,538 | * | 9/1973 | Fabiano | 211/70.6 |
| 4,212,431 | * | 7/1980 | Doyel | D7/695 X |
| 4,775,057 | * | 10/1988 | Zingeser | 211/133.1 |
| 5,033,366 | * | 7/1991 | Sullivan | 99/483 |
| 5,123,337 | * | 6/1992 | Vilgrain et al. | 99/483 |
| 5,186,335 | * | 2/1993 | Fahey et al. | 211/10 |
| 5,497,888 | * | 3/1996 | Michaels et al. | 211/10 |
| 5,590,794 | * | 1/1997 | Zachary | 211/10 |
| 6,102,215 | * | 8/2000 | Guida | 211/70.6 |
| 6,123,205 | * | 9/2000 | Dumitrescu et al. | 211/74.01 |

* cited by examiner

*Primary Examiner*—Daniel P. Stodola
*Assistant Examiner*—Jennifer E. Novosad
(74) *Attorney, Agent, or Firm*—Rodger H. Flagg

(57) ABSTRACT

A confectioner's work station for the organization, display and storage of equipment, books and supplies used by the confectioner in the practice of their art. The work station includes a pastry bag rack sub-assembly, a tube rack sub-assembly, a magazine and tool rack sub assembly, and a coloring bottle rack sub-assembly, which are housed between a bottom portion, a left side portion, a top portion and a right side portion. The coloring bottle rack sub assembly stores the coloring bottles in an inclined position. The pastry bag rack sub assembly features clips which are secured to rods to releasably secure pastry bags thereto. The tube rack sub-assembly features a plurality of inclined pegs extending from the back portion of the work station. The inclined pegs are spaced apart and sized to receive tubes thereon. The magazine and tool rack sub assembly includes inclined partitions sized to receive magazines and books therebetween. The lower portion includes a tool storage location, which may include a compact air compressor and tools for air brush techniques. The confectioner's work station may be wall mounted, or positioned upon a suitable planar surface, such as a table or countertop.

18 Claims, 2 Drawing Sheets

CONFECTIONER'S WORKSTATION

CROSS REFERENCE TO RELATED APPLICATIONS

This application claims the benefit of priority pursuant to 35 USC §119(e)(1) from the provisional patent application filed pursuant to 35 USC §111(b); as Ser. No. 60/113,533 on Dec. 22, 1998.

BACKGROUND OF THE INVENTION

A confectioner must utilize multiple confectioner tools to quickly and efficiently decorate cakes, pies, pastries, cookies, candies, hordevors, deserts, and other foods featuring a decorative coating thereon. Do to the quantity of confectioner tools and supplies, there is a need to provide a confectioner's workstation to organize, display and utilize these tools and supplies. The confectioner often references books on the subject, and a provision for confectioner's books is also provided.

Often a confectioner works from a flat planar surface, such as a table, and the tools and supplies often take up valuable working space, and get in the way of the confectioner at work. Thus, what is needed is a variety of easily accessible storage locations adapted to fit the tools, supplies and books used by confectioners when practicing their art.

U.S. Pat. No. 1,614,342, issuing on Jan. 11, 1927 by F. Bleckley discloses a kitchen tool holder supported upon a wall, and adapted to support a variety of cutlery, such as knives. This patent utilizes a spring biased clamping strip to hold the tools against the body of the invention.

U.S. Pat. No. 3,759,538 issuing on Sep. 18, 1973 to Anthony Fabiano discloses a wheeled garden caddy, having multiple planar surfaces with hooks and apertures for holding garden implements, accessories and supplies.

U.S. Pat. No. 4,739,885 issuing on Apr. 26, 1988 to Noland et al. discloses a rack for holding food mixer attachments. The rack is adapted to be attached to the underside of a kitchen cabinet.

U.S. Pat. No. 4,730,799 issuing on Mar. 15, 1988 to Foss et al. discloses a glue gun organizer made of wire for supporting a glue gun, glue sticks, and a parts tray. The wire structure acts as a heat sink to cool the glue gun between use.

U.S. Pat. No. 5,447,242 issuing Sep. 5, 1995 to Kelley et al. discloses a tall book display rack made of a single sheet of transparent material supported on opposing sides. The transparent material is formed into a wave defining a plurality of valley sized to receive books therein. Each valley is raised in relation to the preceding valley.

U.S. Pat. No. 5,620,105 issuing on Apr. 15, 1997 to Thomas Macek discloses a storage caddy for personal care products, which hangs from an inverted U-shaped portion. Spaced apart wire provides apertures for receiving various personal care products therein.

U.S. Pat. No. 5,615,782 issuing on Apr. 1, 1997 to In Choe discloses a work stand for supporting a variety of hair styling instruments in an organized manner. Oval shaped cutouts are provided to receive and support the hair styling instruments.

SUMMARY OF THE INVENTION

The confectioner's workstation disclosed herein, is supported upon a wall or planar surface, and provides multiple storage locations for a variety of confectionery tools, supplies, equipment and books. The confectioner's workstation includes a provision for holding fresh or used pastry bags which are stored on clips supported upon rods. Multiple tube supports are arranged by size and design. A cake-coloring portion is also provided for storing bottles of cake coloring. A combination tool and magazine rack is also provided. A provision may also be provided for an air brush compressor and air brush. All of these features are combined into a single confectioner's workstation.

Other objects and features of the present invention will become apparent from a consideration of the following description which proceeds with reference to the accompanying drawings, wherein example embodiments of the invention are selected by way of illustration and not by way of restriction.

DETAILED DESCRIPTION OF THE DRAWINGS

DETAILED DESCRIPTION OF THE PREFERRED EMBODIMENTS

Figure 2:
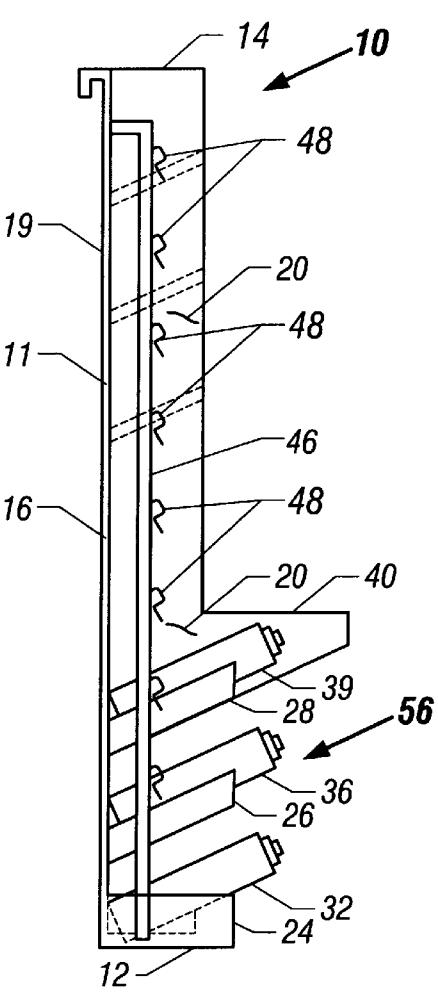
FIG. 2 is a side view of the confectioner's workstation, showing the pastry bag rack sub-assembly.

Referring to FIGS. 1 through 5, the confectioner's workstation 10 comprises a framework sub-assembly 11 having a bottom 12, a top 14, a left side 16, a right side 18 and a back portion 19. A vertical portion 20, extends at least partially from the top 14 to a second horizontal sculpted face member 26. The confectioner's work station 10 is designed to accommodate in combination, a pastry bag rack sub-assembly 50, a tube rack sub-assembly 52, a coloring bottle rack sub-assembly 56 and a magazine and tool rack sub-assembly 54.

The confectioner's work station 10 may be made of any conventional material, such as wood, plastic, metal, etc. Preferably, the framework subassembly 11 is made of a food grade, polyethylene plastic, and is preferably made by a rotational molding process. The confectioner's work station 10 may be painted, stained, coated or otherwise treated to provide an attractive appearance.

Figure 1:
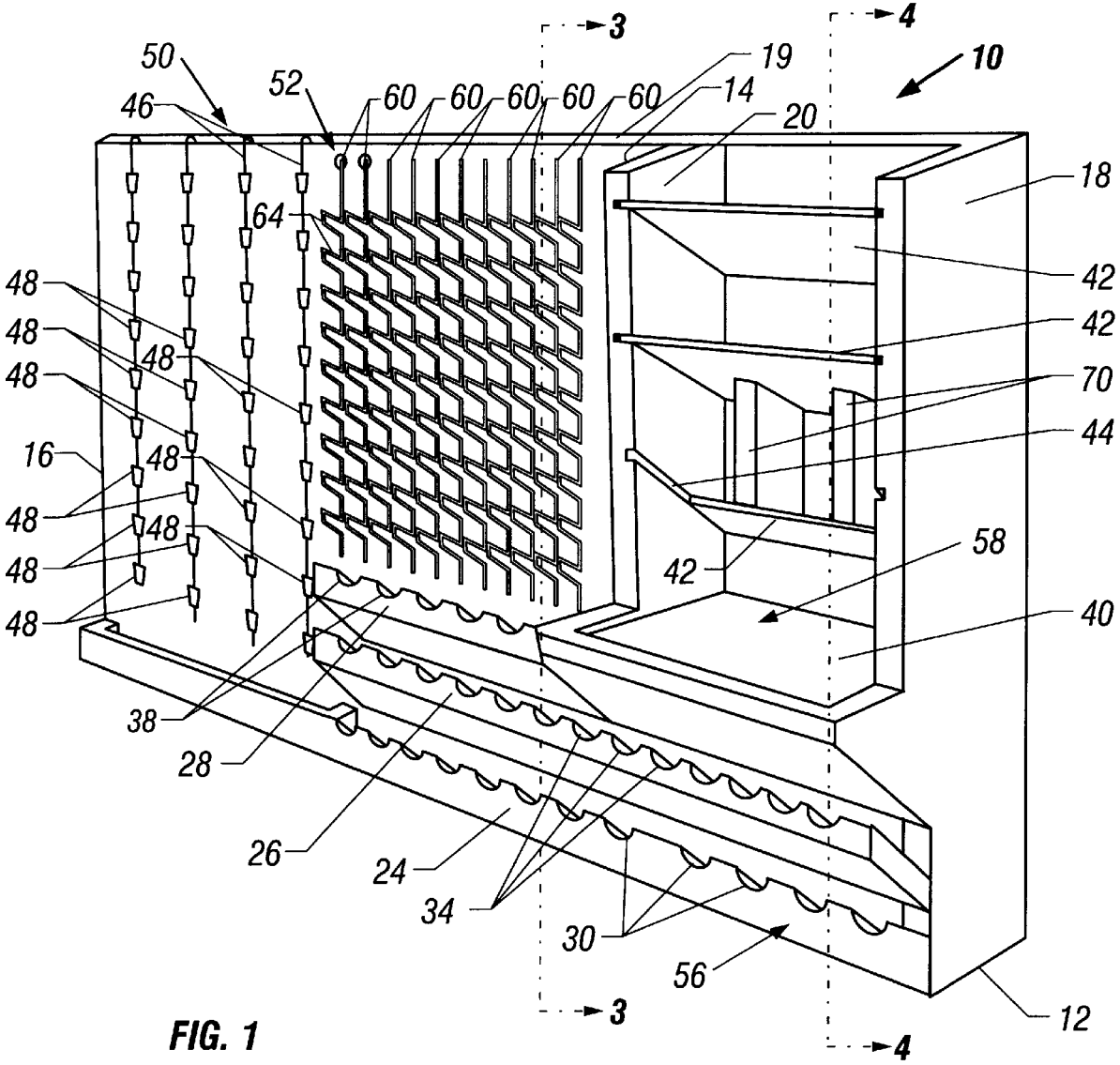
FIG. 1 is a front view of the confectioner's workstation.

As best shown in FIG. 1, the bottle rack sub-assembly 56 preferably comprises a first lower horizontal sculpted face member 24 extending between pastry rack sub-assembly 50 and vertical portion 20 in spaced relation above the bottom portion 12. Preferably, the bottle rack sub-assembly 56 further comprises a second horizontal sculpted face member 26 extending between the pastry rack sub-assembly 50 and the right side portion 18 of the framework sub-assembly 11 in spaced relation above the first horizontal sculpted face member 24. A third horizontal sculpted face member 28 preferably extends between the pastry bag rack sub-assembly 50 and the vertical portion 20 in spaced relation above the second horizontal sculpted face member 26.

Figures 3, 4, 5:
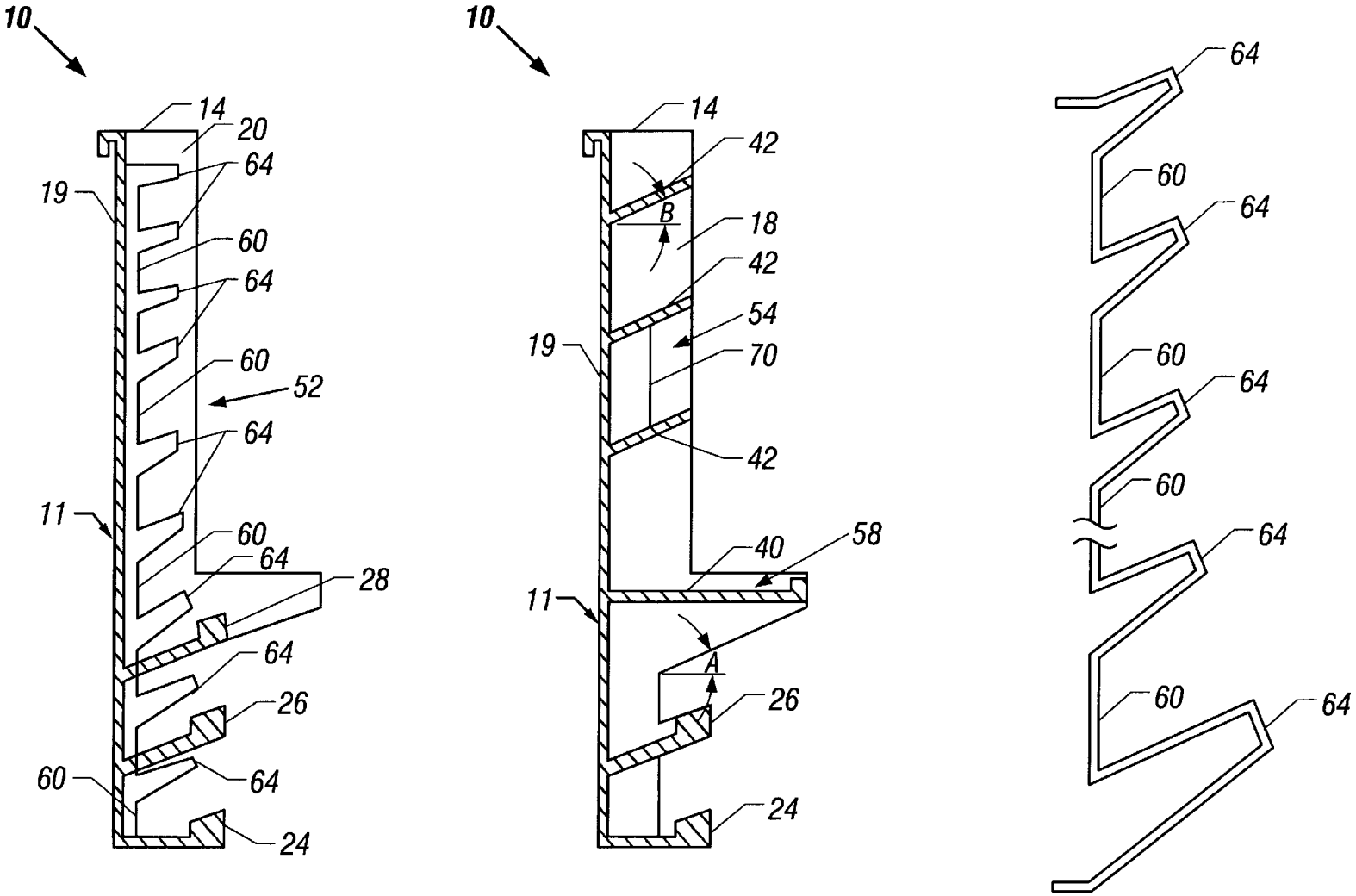
FIG. 3 is a cross sectional view taken along lines 3—3 in FIG. 1.
FIG. 4 is a cross sectional view taken along lines 4—4 in FIG. 1.
FIG. 5 is a side view of one of the vertically disposed wire sub-assembly.

As best shown in FIG. 1 and FIG. 4, the first sculptured face member 24 has a plurality of first arcuate cutouts 30 sized to receive a plurality of bottles 32. The bottles 32 preferably each contain about 8 ounces of cake coloring. The first sculptured face member 24 preferably extends horizontally, adjacent to the bottom portion 12 and between the pastry rack sub-assembly 50 and the right side 18.

The second sculptured face member 26 has a plurality of second arcuate cutouts 34 preferably sized to receive a plurality of bottles 36, which may be of a different size than bottles 32. The bottles 36 preferably contain cake coloring. The second sculptured face member 26 preferably extends in spaced relation above the first sculptured face member 24 and between the pastry rack sub-assembly 50 and the right side portion 18.

A third sculptured face member 28 has a plurality of third arcuate cutouts 38 preferably sized to receive a plurality of bottles 39, which may be of a different size than bottles 32 or bottles 36.

The first, second and third sculptured face members 26, 32 preferably have arcuate cutouts 28, 34 which are sized to support bottles 32, 36 or 39 from one inch to three inches in diameter. The first, second and third sculptured face members 24, 26 and 28 thus combine to form the coloring bottle rack sub-assembly 56.

As best shown in FIG. 1 and FIG. 4, an air brush compressor (not shown) may be positioned on the horizontal platform 40, between the right side portion 18, the vertical portion 20 at a location above the second horizontal sculpted face member 26 and below the tool rack sub assembly 54, thus forming an air brush compressor sub-assembly 58 whereby a bottom portion of the platform 40 is inclined, at A, from 15 to 50 degrees, relative to the horizontal.

Several inclined cross-members or shelves 42, which are inclined, at B, from 15 to 50 degrees, relative to the horizontal, are sized to extend between the right side member 18 and the vertical member 20. For ease of assembly, the inclined cross members 42 may be slidably received in slots 44. The inclined cross members 42 are preferably positioned in spaced relation between the horizontal platform 40 and the top portion 14. The inclined cross-members 42 are spaced apart sufficiently to receive books or magazines (not shown) therebetween, and thus form the magazine and tool rack sub-assembly 54.

One or more vertical partitions 70 may extend between adjacent inclined cross members 42 to further divide the cross members 42, according to use. The vertical partitions 70 are useful for providing storage for various tools, in addition to separating a plurality of magazines stored on the inclined cross members 42.

For ease of assembly, the magazine and tool rack sub assembly 54 may be preassembled, and secured between the vertical portion 20 and the right side portion 18.

As best shown in FIG. 3, a plurality of vertically disposed wire subassemblies 60 having multiple protrusions 64 are supported from apertures, in the back panel portion 19, in spaced, side-by-side relation. The vertically disposed wire sub-assemblies 60 are positioned to extend from the back panel portion 19, between the top 14 and the third horizontally disposed sculpted face member 28 and between the pastry rack sub-assembly 50 and the vertical portion 20.

As best shown in FIG. 5, the multiple protrusions 64 on the vertically disposed wire sub-assemblies 60 are positioned to support a variety of sizes of tubes (not shown) thereon. Preferably, the tubes are positioned on the multiple protrusions 64 in order of frequency of use, or in order of tube size, according to project requirements, or according to the confectioner's preference. The vertical wire sub-assemblies 60 forming the tube rack sub assembly 52 are preferably aligned and secured to the framework 11 in columns and rows, and the spacing between the multiple protrusions 64 and the size of the protrusions 64 may be varied to better accommodate larger or smaller spacing between the multiple protrusions 64.

The multiple protrusions 64 are preferably spaced from three-quarters of an inch to three inches apart, from centerline to centerline. The multiple protrusions 64 are preferably sized to extend from three-quarters of an inch to six inches from the back portion 19 of the framework sub-assembly 11. The length of the multiple protrusions 64 are preferably sized to suit the type and size of tube to be supported thereon. Alternately, a plurality of inclined pegs (not shown) may extend from closely received apertures located in the back portion 19 of the framework sub-assembly 11, in place of the multiple protrusions 64 referenced above.

The inclined pegs may be adjustably positioned in any one of a plurality of peg apertures located in the back portion 19 of the framework sub-assembly 11, or the inclined pegs may alternately be secured in place by any other known conventional means, such as by gluing, screwing, etc.

As best shown in FIG. 1 and FIG. 2, a pastry bag rack portion 50 is secured to the framework 11. The pastry bag rack portion 50 extends between the left side portion 16, the top 14 and the bottom 12, and about half way towards the vertical portion 20. One or more rods 46 extend in spaced relation between the bottom portion 12 and the top portion 14.

A plurality of clips 48 are supported upon the rods 46. The clips 48 are secured to the rod 46 in spaced relation, so that multiple pastry bags may be releasably secured beneath the clips 48. The clips 48 are used to releasably secure pastry bags (not shown) for ease of access. The clips 48 each have opposing sides that are biased together to releasably clamp an object, such as pastry bags, therebetween. The clips may be permanently secured a rod 46, such as by welding, gluing, bolting, etc., or may be adjustably secured to the rod 46 by any known conventional means, to suit user or manufacturing preference. Preferably the rods 46 are made of stainless steel. The clips may be made of plastic or metal.

It is understood that it is within the scope of this disclosure, to modify this invention by rearranging the position of the various sub-assemblies disclosed herein, and such modifications are intended to be included within the scope of this invention. By way of an example embodiment of such a modification, the various sub-assemblies may be positioned in mirror image to the confectioner's workstation 10 shown in FIG. 1.

FIG. 2 shows a side view of the confectioner's workstation 10 shown in FIG. 1. As shown in FIG. 2, the lower portion of the framework sub-assembly 11 may be wider than the upper portion, to provide additional space to support inclined coloring bottles 32, and to provide additional support for a confectioner's work station 10 mounted on a planar surface, such as a counter top (not shown).

The confectioner's workstation may be wall mounted or mounted to a horizontal planar surface, such as a table, or countertop, with any known securement means, such as bolts, screws, clamps, brackets, etc., to suit the layout of the confectioner's working area. Suitable mounting brackets (not shown) may be used to secure the confectioner's work station 10 to either the wall or to a suitable planar surface in a manner will known in the art.

Thus, the confectioner's work station 10 comprises framework 11 for supporting a pastry bag rack sub-assembly 50, a tube rack sub-assembly 52, a magazine and tool rack sub-assembly 54, a coloring bottle rack sub-assembly 56, and an air-brush compresser sub-assembly 58, which are housed between the bottom portion 12, left side portion 16, top portion 14 and right side portion 18 of the framework 11.

While the confectioner's workstation 10 has been shown and described in the form of preferred embodiments of this invention, it is understood that this invention is not limited to the specific details disclosed herein, and it is further recognized that one skilled in this art may make numerous departures and modifications which fall within the scope of this disclosure, and such departures and modifications are intended to fall within the scope of the following claims.

We claim:

1. A confectioner's workstation apparatus, comprising in combination:

a) a framework sub-assembly having a bottom, a top, a left side, a right side, a back, and a vertical portion extending from the top towards the bottom, in spaced relation from the right side, the back adapted for securement to a vertical wall, and the bottom adapted for alternate securement to a horizontal table surface;

b) a pastry rack sub-assembly having a plurality of vertically spaced rods extending from the top of the framework sub-assembly substantially towards the bottom in spaced relation between the left side and about half way towards the first vertical portion, each of said rods having a plurality of clips secured thereto, each of said clips sized to releasably secure a pastry bag thereto;

c) a bottle sub-assembly comprising a first lower, horizontally disposed sculpted face member having a plurality of spaced arcuate cutouts, each of said cutouts sized to support a bottle therein, a second horizontally disposed sculpted face member secured to the framework sub-assembly in spaced relation above the first face member, and extending between the pastry bag rack sub-assembly and the right side of the framework sub-assembly, and a third horizontally disposed sculpted face member secured to the framework sub-assembly in spaced relation above the second face member, and extending between the pastry bag rack sub-assembly and the vertical portion;

d) a tube rack sub-assembly extending between the pastry bag rack sub-assembly and the vertical portion in a first direction, and the top, and the third horizontally disposed sculpted face member in a second direction, the tube rack sub-assembly further comprising a plurality of vertically disposed wire sub-assemblies, each of said wire assemblies having a plurality of protrusions for receiving a variety of sizes of tubes in spaced relation thereon;

e) a shelf sub-assembly having at least two inclined horizontal shelves positioned in spaced relation between the top of the framework sub-assembly and the second sculpted face member, with at least one vertical divider extending in spaced relation between the vertical portion and the right side of the framework sub-assembly, the at least one vertical divider further located in spaced relation between at least one adjacent set of inclined horizontal shelves; and f) an air-brush compressor platform positioned above the second sculpted face member and below the shelf sub-assembly, and between the vertical portion and the right side of the framework sub-assembly.

2. The confectioner's work station apparatus of claim 1, wherein the framework sub-assembly is made of a food grade, polyethylene plastic.

3. The confectioner's work station apparatus of claim 1, wherein the pastry rack sub-assembly is made of a plurality of stainless steel rods secured to the back of the framework sub-assembly, each stainless steel rod having a plurality of clips adjustably secured thereto.

4. The confectioner's work station apparatus of claim 1, wherein each of the shelves of the shelf sub-assembly is inclined from 15 degrees to 50 degrees.

5. The confectioner's work station apparatus of claim 1, wherein a bottom portion of the compressor platform is inclined from 15 degrees to 50 degrees.

6. The confectioner's work station apparatus of claim 1, wherein the framework sub-assembly is made by a plastic rotational molding process.

7. A wall mounted confectioner's workstation apparatus, comprising in combination:

a) a framework sub-assembly having a bottom, a top, a left side, a right side, a back, and a vertical portion extending from the top in spaced relation from the right side portion, and a back portion adapted for securement to a vertical wall, the framework sub-assembly made of food grade plastic;

b) a pastry rack sub-assembly having a plurality of vertically spaced rods extending from the top of the framework sub-assembly substantially towards the bottom in spaced relation between the left side and about halfway towards the vertical portion, each of said rods having a plurality of clips secured thereto, each of said clips sized to releasably secure a pastry bag thereto;

c) a bottle sub-assembly comprising a first lower, horizontally disposed sculpted face member having a plurality of spaced arcuate cutouts, each of said cutouts sized to support a bottle therein, a second horizontally disposed sculpted face member secured to the framework sub-assembly in spaced relation above the first face member, and extending between the pastry bag rack sub-assembly and the right side of the framework sub-assembly, and a third horizontally disposed sculpted face member secured to the framework sub-assembly in spaced relation above the second face member, and extending between the pastry bag rack sub-assembly and the vertical portion;

d) a tube rack sub-assembly extending between the pastry bag rack sub-assembly and the vertical portion in a first direction, and the top and the third horizontally disposed sculpted face member in a second direction, the tube rack sub-assembly further comprising a plurality of vertically disposed wire subassemblies, each of said wire assemblies having a plurality of protrusions for receiving a variety of sizes of tubes in spaced relation thereon;

e) a shelf sub-assembly having at least two inclined horizontal shelves positioned in spaced relation between the top of the framework sub-assembly and the second sculpted face member; and f) an air-brush compressor platform positioned above the second sculpted face member and below the shelf sub-assembly, and between the vertical portion and the right side of the framework sub-assembly.

8. The wall mounted confectioner's work station apparatus of claim 7, wherein at least two vertical dividers extend in spaced relation between the vertical portion and the right side of the framework sub-assembly, the vertical dividers further located in spaced relation between at least one adjacent set of inclined horizontal shelves.

9. The wall mounted confectioner's work station apparatus of claim 7, wherein the pastry rack sub-assembly is made of a plurality of stainless steel rods, each stainless steel rod having a plurality of plastic clips adjustably secured thereto.

10. The wall mounted confectioner's work station apparatus of claim 7, wherein each of the shelves of the shelf sub-assembly is inclined from 15 degrees to 50 degrees.

11. The wall mounted confectioner's work station apparatus of claim 7, wherein a bottom portion of the compressor platform is inclined from 15 degrees to 50 degrees.

12. The wall mounted confectioner's work station apparatus of claim 7, wherein the framework sub-assembly is made by a plastic rotational molding process.

13. A table mounted confectioner's workstation apparatus, comprising in combination:

a) a framework sub-assembly having a bottom, a top, a left side, a right side, a back and a vertical portion extending from the top in spaced relation from the right side, and the bottom adapted for securement to a horizontal table surface;

b) a pastry rack sub-assembly having a plurality of vertically spaced rods extending from the top of the framework sub-assembly substantially towards the bottom in spaced relation between the left side and about half way towards the vertical portion, each of said rods having a plurality of clips secured thereto, each of said clips sized to releasably secure a pastry bag thereto;

c) a bottle sub-assembly comprising a first lower, horizontally disposed sculpted face member having a plurality of spaced arcuate cutouts, each of said cutouts sized to support a bottle therein, a second horizontally disposed sculpted face member secured to the framework sub-assembly in spaced relation above the first face member, and extending between the pastry bag rack sub-assembly and the right side of the framework sub-assembly, and a third horizontally disposed sculpted face member secured to the framework sub-assembly in spaced relation above the second face member, and extending between the pastry bag rack sub-assembly and the vertical portion;

d) a tube rack sub-assembly extending between the pastry bag rack sub-assembly and the vertical portion in a first direction, and the top and the third horizontally disposed sculpted face member in a second direction, the tube rack sub-assembly further comprising a plurality of vertically disposed wire subassemblies, each of said wire assemblies having a plurality of protrusions for receiving a variety of sizes of tubes in spaced relation thereon;

e) a shelf sub-assembly having at least two inclined horizontal shelves positioned in spaced relation between the top of the framework sub-assembly and the second sculpted face member with at least one vertical divider extending in spaced relation between the vertical portion and the right side of the framework sub-assembly, the at least one vertical divider further located in spaced relation between at least one adjacent set of inclined horizontal shelves; and f) an air-brush compressor platform positioned above the second sculpted face member and below the shelf sub-assembly, and between the vertical portion and the right side of the framework sub-assembly.

14. The table mounted confectioner's work station apparatus of claim 13, wherein the framework sub-assembly is made of a food grade, polyethylene plastic.

15. The table mounted confectioner's work station apparatus of claim 13, wherein the pastry rack sub-assembly is made of a plurality of stainless steel rods, each stainless steel rod having a plurality of clips adjustably secured thereto.

16. The table mounted confectioner's work station apparatus of claim 13, wherein each of the shelves of the shelf sub-assembly is inclined from 15 degrees to 50 degrees.

17. The table mounted confectioner's work station apparatus of claim 13, wherein a bottom portion of the compressor platform is inclined from 15 degrees to 50 degrees.

18. The table mounted confectioner's work station apparatus of claim 13, wherein the framework sub-assembly is made by a plastic rotational molding process.

* * * * *